US006672736B2

(12) United States Patent
Waldman

(10) Patent No.: US 6,672,736 B2
(45) **Date of Patent: *Jan. 6, 2004**

(54) LATCH MEMBER WITH A LIGHTING ASSEMBLY FOR A RURAL MAILBOX

(76) Inventor: Daniel G. Waldman, 11871 Broadway, Moorpark, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 28 days.

(21) Appl. No.: 09/997,292

(22) Filed: Nov. 27, 2001

(65) Prior Publication Data

US 2003/0099103 A1 May 29, 2003

(51) Int. Cl.[7] ..... F21V 33/00
(52) U.S. Cl. ..... 362/155; 362/154; 362/100
(58) Field of Search ..... 362/154, 155, 362/800, 190, 802, 94, 100, 133, 501; 232/17, 34, 35, 37

*Primary Examiner*—Sandra O'Shea
*Assistant Examiner*—Bao Q Truong
(74) *Attorney, Agent, or Firm*—W. Edward Johansen

(57) ABSTRACT

A mailbox includes a housing, a door and a male latch member. The housing has a base and a curved top. The door has a top and a bottom and is hinged to the base of the housing adjacent to the bottom of the door. The male latch member is mechanically coupled to the door and is disposed adjacent to the top of the door. A female latch member is coupled to the housing and is disposed so that the male latch member engages the female latch member. The female latch member has a base portion, a handle portion, a ribbed reinforcement portion and two clip-connector portions. A battery-housing portion is disposed on the top of the base portion. A battery assembly is received in the battery-housing portion and has two electrodes. A lighting assembly is disposed in the base portion adjacent to the handle portion and includes a light emitting diode.

1 Claim, 1 Drawing Sheet

Fig. 1. (Prior Art)
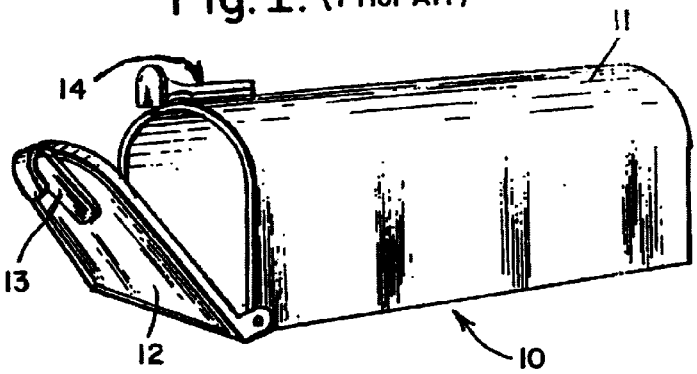
Fig. 3. (Prior Art)
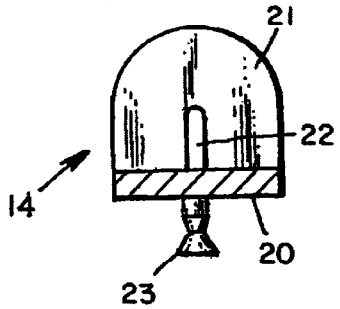
Fig. 2. (Prior Art)
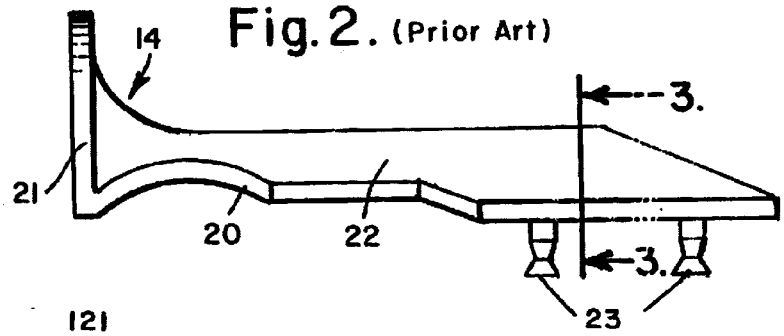
Fig. 6.
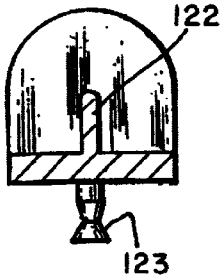
Fig. 4.
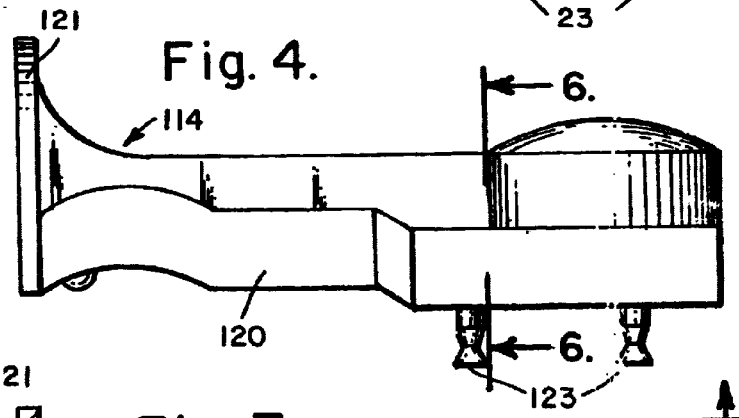
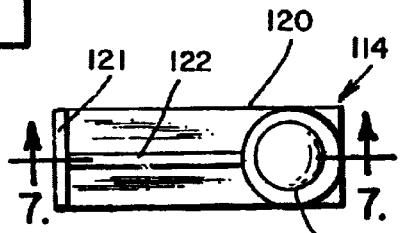
Fig. 5.
Fig. 7.
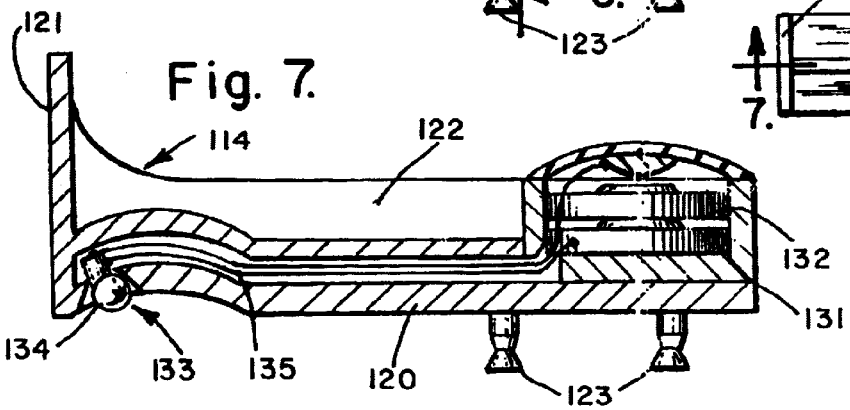

LATCH MEMBER WITH A LIGHTING ASSEMBLY FOR A RURAL MAILBOX

BACKGROUND OF THE INVENTION

The present invention relates to a lighting assembly for a rural mailbox and more particularly to a lighting assembly for a mailbox which an user activates a light when he open of a door so there is sufficient ambient light by which to view the contents therein.

Many persons have employment schedules that result in returning home in the dark. Of course, many persons working normal business hours also return home in the dark during the winter season due to the shortened period of daylight. The task of gathering one's mail from the mailbox is made more difficult by the darkness. The resident must scrape around inside the darkened mailbox or utilize an external light source such as a flashlight to ensure that important letters or small packages are not overlooked. Interior lighting of a mailbox is especially needed for use with rural mailboxes that are typically mounted some distance away from the home. Various apparatus have been proposed for lighting the interior of a mailbox. Some such devices are disadvantageous, however, in that a light is activated every time the mailbox door is opened, thus depleting the power supply even in situations where ambient light is plenteous. Other devices require the user to manually activate a light switch when more light is needed.

Therefore, it is desirable to have a lighting system for a mailbox that activates an interior light only if insufficient ambient light is available for viewing the contents within the mailbox. It is further desirable that the amount of available ambient light is only sensed upon an opening of the mailbox door.

U.S. Pat. No. 4,160,887 teaches a switch that operates a lamp bulb in a compartment in response to the opening and closing of the compartment's lid. The switch includes a housing that retains the bulb and mounts in an aperture adjacent the compartment. The housing includes a hinge that is pivoted from a first to a second position when the lid is closed. A pair of contacts on opposite sides of the housing includes terminals that connect into an electrical circuit. One end of one contact engages the bulb contact. One end of the other contact engages the bulb base and biases the hinge member into its first position. When the lid is open, the hinge is in its first position and the circuit through the bulb is complete. Closing of the lid pivots the hinge to its second position and moves the end of the other contact away from the bulb to break the circuit.

U.S. Pat. No. 4,577,262 teaches a container for storage on an offshore work site. A lightweight metal container is provided with a latching mechanism that is operable by either hand or foot pressure for allowing opening of the container. The container has attached thereto a spring-loaded assembly for causing automatic opening of the top upon release of the latching mechanism from the top. A power source, switch and lamp are attached to the container for automatic illumination of the contents therein upon opening of the top.

U.S. Pat. No. 4,755,915 teaches a lighting fixture which has self-contained batteries and mercury switch for attachment of the fixture to the interior surface of the door of a mailbox for illuminating the box interior when the door is opened. The mercury switch is manually adjustable about a lateral axis so that the fixture may be used on either front opening or top tilting doors.

U.S. Pat. No. 4,648,012 teaches a lighting assembly that lights the interior of a metal mailbox. The metal mailbox has a rectangular bottom, a curved top, two side sections, a closed rear end, an open front end and a hinged cover. The hinged cover is pivoted about the horizontal base and has at its top a latch which when the cover is closed against the open front end of the box couples with a matching latch that is mounted at the top of the front end of the mailbox. The lighting assembly is an incandescent lamp that has two terminals and that is mounted in a socket depending from the top of the mailbox. A dry cell battery is contained within an insulated case mounted beneath the bottom of the mailbox. A push button on-off switch has two terminals mounted on the latch at the front end of the mailbox. An insulated line connects one terminal of the battery to one terminal of the on-off switch. A second insulated line connects the other terminal of the on-off switch to one terminal of the incandescent lamp. The other terminal of the battery is connected to the other terminal of the incandescent lamp through the grounded metal mailbox itself.

Rural mailboxes approved by the U.S. Postal Service conventionally are made of metal with a rectangular horizontal base, a curved top and side section, a closed rear end and an open front end. A hinged door is pivoted near the horizontal base with a latch at its top which, when the door is closed against the open front end of the box, couples with a matching latch on the top of the front end of the box. These boxes are usually located along the road some distance from the owner's house. The rural mailbox usually receives mail delivered by a mail carrier during daylight hours. But when the homeowner is employed away from home the box is often checked for mail during the hours of darkness. When the box is opened to determine whether it contains envelopes, post cards or small packages when it is dark or gloomy, it is difficult to quickly and accurately determine whether all the delivered mail is being removed from the box. It is impossible to visually check the contents of the rural mailbox when it is gloomy or during the hours of darkness.

Even when either streetlights nearby or headlights of an automobile illuminate a rural mailbox the interior of the rural mailbox is literally a black hole. The person who is checking the box for mail is unable to visually determine the contents of the mailbox during either late evening hours or early morning hours. There is a need for an apparatus for lighting the interior of a conventional rural mailbox in order to permit the owners of mailboxes that are often emptied during the hours of darkness to visually inspect the contents of their mailboxes. Since most mailboxes are located at a point where conventional 110 volt alternating electric current is not readily available, the apparatus is powered by a pair of 1.5 volt AA dry cell batteries that are protected from the rain and weather by a polyvinyl case located beneath the mailbox. Light to the inside of the box is supplied by an incandescent lamp mounted in a socket attached to the roof of the mailbox. Electricity is fed to the lamp by a pushbutton on-off switch conveniently mounted on the latch that secures the box cover in closed position. When the person desiring to check the box for mail grasps the latch to open the box he will also push the button on the switch to turn on the lamp and illuminate the interior of the mailbox. Then when the contents of the box have been removed and the person is assured by visual inspection that the box is now empty, the person closes the box cover and again pushes the switch button to turn off the lamp.

U.S. Pat. No. 5,813,749 teaches an internal lighting system for rural mailboxes that provides a maintenance-free mailbox internal lighting system by providing a solar cell charging system and rechargeable batteries to the circuitry. The opening of the door automatically actuated the internal light. All the components of the internal lighting system are undetectable to the casual observer to provide a degree of protection from vandalism or theft.

U.S. Pat. No. 6,033,084 teaches a retrofittable mailbox light system. The mailbox includes a housing that has a releasable coupling mechanism mounted on the housing for allowing the housing to be mounted to an inner surface of the mailbox such that a front face of the housing remains flush with the open front of the mailbox. A lamp is mounted to the housing for illuminating the interior space of the mailbox only upon the receipt of power. A battery is positioned within an interior space of the housing. A momentary switch is mounted to the housing and is connected between the lamp and the battery. The switch is adapted for supplying the lamp with power only upon the release thereof when the lid of the mailbox is opened.

The use of a mailbox light apparatus is known in the prior art. Mailbox light apparatuses heretofore devised and utilized for the purpose of lighting a mailbox are known to consist basically of familiar, expected and obvious structural configurations, notwithstanding the myriad of designs encompassed by the crowded prior art that have been developed for the fulfillment of countless objectives and requirements. The prior art includes U.S. Pat. No. 3,935,994, U.S. Pat. No. D313,106, U.S. Pat. No. 4,442,278 and U.S. Pat. No. 5,385,295.

U.S. Pat. No. 6,102,548 teaches a lighting system which illuminates the interior of a mailbox having a bottom wall, a side and arcuate top wall, a closed rear wall, an open front, and a door pivotally attached to the bottom wall for selectively closing the open front. The lighting system includes a light source positioned within the interior of the mailbox. The lighting system further includes a battery power source mounted within the mailbox. A light sensor is positioned within the mailbox for sensing the level of ambient light within the interior thereof. The lighting system includes an electromagnetic sensor that permits current from the power source to be transmitted to the light sensor upon an opening of the mailbox door. If the level of ambient light sensed by the light sensor is below a predetermined level, the light source is energized to illuminate the interior of the mailbox. Current to the light sensor and light source is interrupted upon a closing of the mailbox door.

Mailboxes for rural mail delivery have either one or two indicator flags, one flag for indicating to the mail deliverer that mail is present in the mailbox for pick up and the second flag for indicating to the mail recipient, from a remote location, that mail has been delivered.

Some examples of rural mailboxes having one flag indicator means are generally taught in U.S. Pat. Nos. 4,754,918, 4,771,941, 4,805,834, 4,840,307, 5,273,207 and 5,094,386. Examples of rural mailboxes having two flag indicator means are generally taught in U.S. Pat. Nos. 4,655,390, 5,092,517, and 5,119,986. Some of these patents teach a mailbox with a flag indicator that is automatically actuated upon the opening of the mailbox door for indicating the delivery of mail. Some of these patents, such as U.S. Pat. No. 3,825,173 and U.S. Pat. No. 5,119,986 teach a mailbox that has all plastic components. U.S. Pat. No. 3,825,173 teaches mailbox components as being separately formed and made of a plastic material and U.S. Pat. No. 5,119,986 teaches mailbox components, such as the side walls, floor, and roof as being unitarily molded of conventional plastic material.

Most of these rural mailboxes are either bought by the consumer in an assembled form or are bought in a disassembled form. The several components may be individual pieces that are packaged and shipped for assembling by the consumer.

Since the mailbox is in a disassembled form and several components are individual pieces and not connected together, some of these pieces can easily be lost. The appropriate number and/or kind of component necessary for the assembling of the mailbox can easily be excluded from the package so that it may be impossible for the consumer to assemble the mailbox. Either some or all of the several mailbox components should, in some fashion or the other, be interconnected with each other so as to avoid these instances from occurring.

U.S. Pat. No. 3,013,308 and U.S. Pat. No. 5,207,966 teaches methods for molding several elements. The elements are not used for assembling mailboxes and are of the same kind of element.

U.S. Pat. No. 5,595,341 teaches a rural mailbox that includes housing, a door and auxiliary components. The housing and the door are assembled as a unit. The auxiliary components include a flag bracket, a male latch member, a female latch member, latch clips and a push-pin for securing a flag in the flag bracket. The auxiliary components to the mailbox housing are unitarily molded and integrally formed on a runner member for ease in manufacturing and in packaging with the flag and the assembled housing and door unit. The runner member may also have integrally formed and unitarily molded pins located at strategic locations for wedging a flag therebetween to resist damage such as scratching and/or bending, to the flag during shipping and handling of the mailbox assembly. The several auxiliary components with the runner member may be manufactured of a plastic material through an injection molding process.

U.S. Pat. No. 6,305,814 teaches an apparatus for illuminating keyholes that includes an annular top housing made of rigid material, having recessed and through holes, and a recessed oval pocket having within two through holes. A top housing is slidably coupled over an annular bottom that is made of the same material as the top housing and also has recessed and through holes. A printed circuit board has a transistor, a resistor and a male power connector that are mounted and soldered directly on its surface and is housed and affixed within top housing, by a screw, a plastic spacer and a nut. A photo resistor is housed within a pocket and located on the top housing and its two leads are inserted through the two holes that are located within pocket and soldered directly to the printed circuit board. A light emitting diode that is positioned a predetermined distance below a keyhole has its two leads soldered to the printed circuit board and is housed within the top housing. A battery that is housed within the top housing provides power to printed circuit board by plugging a female connector into a male connector. An electronic circuit is powered by battery controls. The electronic circuit switches "ON" the light emitting diode to illuminate a keyhole from dusk to dawn. There is one through hole located on opposite sides of top housing and one tapped through hole located on opposite sides of bottom housing that facilitate insertion of a 2–56 screw on each side to secure top housing that is mounted over bottom housing, firmly in place.

U.S. Pat. No. 6,305,832 teaches a stirrer which includes a rod, a head, a battery and a light emitting diode. The rod is for stirring a drink. The head is secured onto the rod. The battery is received in the head and has two electrodes. The light emitting diode has two prongs for coupling to the electrodes of the battery. One of the prongs may be selectively coupled to the battery and selectively energizes the light emitting diode. The light emitted by the light emitting diode may be seen through either the rod or the head. The head includes two casings secured together for retaining the battery or the light emitting diode within the head. The light emitting diode may be selectively actuated or energized by a switch.

The inventor incorporates the teachings of the above-cited patents into this specification.

SUMMARY OF THE INVENTION

The present invention relates to a rural mailbox that includes housing, a door, a male latch member, a female latch member and two latch clips. The male latch member has a base that has a top and a bottom. There are two clip-connector portions that mechanically couple the male latch member to the door and disposed adjacent to the top of the door. One of the two latch clips is coupled to the two clip-connector portion of the male latch member in order to secure it to the door. One of the two latch clips secures the male latch member to the door. The female latch member is coupled to the housing and disposed so that the male latch member engages the female latch member. The female latch member includes an integral member that has a base portion with a top and a bottom, a handle portion, a ribbed reinforcement portion and two clip-connector portions. The other latch clip is coupled to the two clip-connector portion of the female latch member in order to secure it to the housing.

In a first separate aspect of the present invention, the female latch member includes a battery-housing portion, a battery assembly and a lighting assembly. The battery housing is disposed on the top of the base portion. The battery assembly is received in the battery-housing portion and has two electrodes. The lighting assembly is disposed in the base portion adjacent to the handle portion and includes a light emitting diode.

Other aspects and many of the attendant advantages will be more readily appreciated as the same becomes better understood by reference to the drawing and the following detailed description.

The features of the present invention which are believed to be novel are set forth with particularity in the appended claims.

DESCRIPTION OF THE DRAWINGS

FIG. 1 is a perspective view of a rural mailbox that includes a housing, a door, a male latch member and a female latch member according to U.S. Pat. No. 5,595,341.

FIG. 2 is a side elevation of the female latch member of FIG. 1.

FIG. 3 is a rear elevation in cross-section of the female latch member of FIG. 1 taken along the line 3—3 of FIG. 2.

FIG. 4 is a side elevation of a female latch member with a lighting assembly according to the present invention.

FIG. 5 is a top plan view of the female latch member with a lighting assembly of FIG. 4.

FIG. 6 is a rear elevation of the female latch member of FIG. 4 taken along the line 6—6 of FIG. 4.

FIG. 7 is a side elevation in cross-section of the female latch member with a lighting assembly of FIG. 4 taken along the line 7—7 of FIG. 5.

DESCRIPTION OF THE PREFERRED EMBODIMENT

Referring to FIG. 1 in conjunction with FIG. 2 a rural mailbox 10 includes housing 11, a door 12 and auxiliary components. The auxiliary components include a male latch member 13, a female latch member 14 and latch clips. The male latch member has a base that has a top and a bottom. There are two clip-connector portions that mechanically couple the male latch member to the door 12 and disposed adjacent to the top of the door 12. One of the two latch clips is coupled to the two clip-connector portion of the male latch member 13 in order to secure the male latch member 13 to the door 12. The female latch member 14 is coupled to the housing 11 and disposed so that the male latch member 13 engages the female latch member 14. The female latch member 14 includes an integral member that has a base portion with a top and a bottom, a handle portion, a ribbed reinforcement portion and two clip-connector portions. U.S. Pat. No. 5,595,341 teaches a rural mailbox that is similar to the rural mailbox 10.

Referring to FIG. 2 in conjunction with FIG. 3 the female latch member 14 is an integral member which has a base portion 20, a handle portion 21, a ribbed reinforcement portion 22 and two clip-connector portions 23. The two clip-connector portions 23 are disposed on the bottom of the base portions 20. The other latch clip is coupled to the two clip-connector portions 23 of the female latch member 14 in order to secure the female latch member to the housing 11. The handle portion 21 is disposed on the top of the base portion 20 at the front end. The ribbed reinforcement portion 22 is disposed on the top 21 of the base portion 20 and extends from the front end to the rear end.

Referring to FIG. 4 in conjunction with FIG. 5 and FIG. 6 a female latch member 114 with lighting assembly includes an integral member that has a base portion 120, a handle portion 121, a ribbed reinforcement portion 122 and two clip-connector portions 123. The handle portion 121 is disposed on the top of the base portion 120 at the front end. The ribbed reinforcement portion 122 is disposed on the top 121 of the base portion 120 and extends from the front end to the rear end. The two clip-connector portions 123 are disposed on the bottom of the base portion 120.

Referring to FIG. 7 in conjunction with FIG. 4 and FIG. 5 the female latch member 114 with lighting assembly includes a battery-housing portion 131, a battery assembly 132 and a lighting assembly 133. The battery-housing portion 131 is disposed on the top of the base portion 120. The battery assembly 132 is received in the battery-housing portion 131 and has two electrodes. The lighting assembly 133 is disposed in the bottom of the base portion 120 adjacent to the handle portion 121 and includes a light emitting diode 134 and two wires 135. The light emitting diode 134 has two prongs that the two wires through a switch 135 couple to the electrodes of the battery assembly 132. One of the prongs may be selectively coupled to the battery assembly 132 and for selectively energizing the light emitting diode 134.

Referring to FIG. 7 in conjunction with FIG. 1, FIG. 2 and FIG. 4 the female latch member 114 with a lighting assembly replaces the female latch member 14 of the rural mailbox 10. The light emitted by the light emitting diode 134 shines on the interior of a rural mailbox. The key to the female latch member 114 with a lighting assembly is that not only its design can be adapted to a variety of female latch members, but also its design is virtually inconspicuous. The light emitting diode 134 is disposed within the handle portion 121.

From the foregoing it can be seen that a female latch member with lighting assembly has been described.

Accordingly it is intended that the foregoing disclosure and drawings shall be considered only as an illustration of the principle of the present invention.

What is claimed is:

1. A female latch member with a lighting assembly for use with a mailbox including:

a. a housing having a base and a curved top;

b. a door having a top and a bottom, said door being hinged to said base of said housing adjacent to said bottom of said door; and c. a male latch member mechanically coupled to said door and disposed adjacent to said top of said door, wherein said female latch member with a lighting assembly is coupled to said housing and is disposed so that said male latch member engages said female latch member wherein said female latch member with a lighting assembly comprises:

i. an integral member having a base portion with a top and a bottom, a handle portion, a ribbed reinforcement portion, two clip-connector portions, a battery housing portion wherein said battery housing portion is disposed on said top of said base portion;

ii. a battery assembly received in said battery housing portion and having two electrodes; and iii. a lighting assembly disposed in said bottom of said base portion adjacent to said handle portion and including a light emitting diode and two wires wherein said light emitting diode has two prongs that said wires couple to said electrodes of said battery assembly.

* * * * *